US012370587B2

(12) United States Patent
Chen

(10) Patent No.: US 12,370,587 B2
(45) Date of Patent: Jul. 29, 2025

(54) METAL MATERIAL PROCESSING MACHINE

(71) Applicant: Tsun-Cheng Chen, Taiwan (TW)

(72) Inventor: Tsun-Cheng Chen, Taiwan (TW)

( * ) Notice: Subject to any disclaimer, the term of this patent is extended or adjusted under 35 U.S.C. 154(b) by 253 days.

(21) Appl. No.: 18/172,275

(22) Filed: Feb. 21, 2023

(65) Prior Publication Data

US 2023/0201898 A1 Jun. 29, 2023

(51) Int. Cl.
*B21B 1/18* (2006.01)
*B21B 1/085* (2006.01)
*B21F 23/00* (2006.01)

(52) U.S. Cl.
CPC ..... *B21B 1/18* (2013.01); *B21B 1/085* (2013.01)

(58) Field of Classification Search
CPC ..... B21B 1/18; B21B 1/085; B21F 23/00; B21D 43/00
See application file for complete search history.

(56) References Cited

U.S. PATENT DOCUMENTS 1,711,160 A * 4/1929 Swangren ..... B21F 23/00 140/140
6,044,682 A * 4/2000 Cheng ..... B21F 23/00 72/307
2004/0154365 A1* 8/2004 Tsuritani ..... B21F 35/00 72/138

FOREIGN PATENT DOCUMENTS

CN 113198952 A * 8/2021 ..... B21D 28/02

OTHER PUBLICATIONS

English translate (CN113198952A), retrieved date Dec. 28, 2024.*

* cited by examiner

*Primary Examiner* — Mohammed S. Alawadi

(57) ABSTRACT

A metal material processing machine along a feeding direction includes a feeding device, a moving device, a guiding device, and first to fourth rail driven devices. The feeding device feeds a metal material along the feeding direction. The moving device moves the metal material forward. The metal material is guided by the guiding device. The metal material is disengaged from the moving device. The metal material moves along a direction opposite to the feeding direction until backs a starting point. The first rail driven device is aligned with the feeding direction. The second rail driven device is aligned with the third rail driven device. The second and third rail driven devices are perpendicular to the feeding direction respectively. The second and third rail driven devices are disposed at two sides of the feeding direction respectively. The fourth rail driven device is aligned with the feeding direction.

10 Claims, 8 Drawing Sheets

METAL MATERIAL PROCESSING MACHINE

FIELD OF THE INVENTION

The invention relates to metal material processing and more particularly to a metal material processing machine having at least four rail driven devices each operating along a unique direction.

BACKGROUND OF THE INVENTION

A conventional wire and band processing machine is erect and has a plurality of radial axes at different elevations respectively. Thus, the axes have different loads and it is difficult to replace one malfunctioned component with a new one. Further, an addition of axes to the processing machine based on requirements is impossible. It has limited applications.

It is also found that the wires and bands may be stuck in a roller driven conveyor in operation.

Thus, the need for improvement still exists.

SUMMARY OF THE INVENTION

It is therefore one object of the invention to provide a metal material processing machine along a feeding direction comprising a feeding device, a moving device, a guiding device, a first rail driven device, a second rail driven device, a third rail driven device, and a fourth rail driven device, wherein the feeding device is configured to feed a metal material along the feeding direction; the moving device is configured to move the metal material forward from a starting point along the feeding direction, the metal material is guided by the guiding device, the metal material is disengaged from the moving device, and the metal material is configured to move along a direction opposite to the feeding direction until backs the starting point; the first rail driven device is aligned with the feeding direction; the second rail driven device is aligned with the third rail driven device, the second rail driven device and the third rail driven device are perpendicular to the feeding direction respectively, and the second rail driven device and the third rail driven device are disposed at two sides of the feeding direction respectively; and the fourth rail driven device is aligned with the feeding direction, and the fourth rail driven device is opposite to the first rail driven device.

The above and other objects, features and advantages of the invention will become apparent from the following detailed description taken with the accompanying drawings

DETAILED DESCRIPTION OF THE INVENTION

Figure 1:
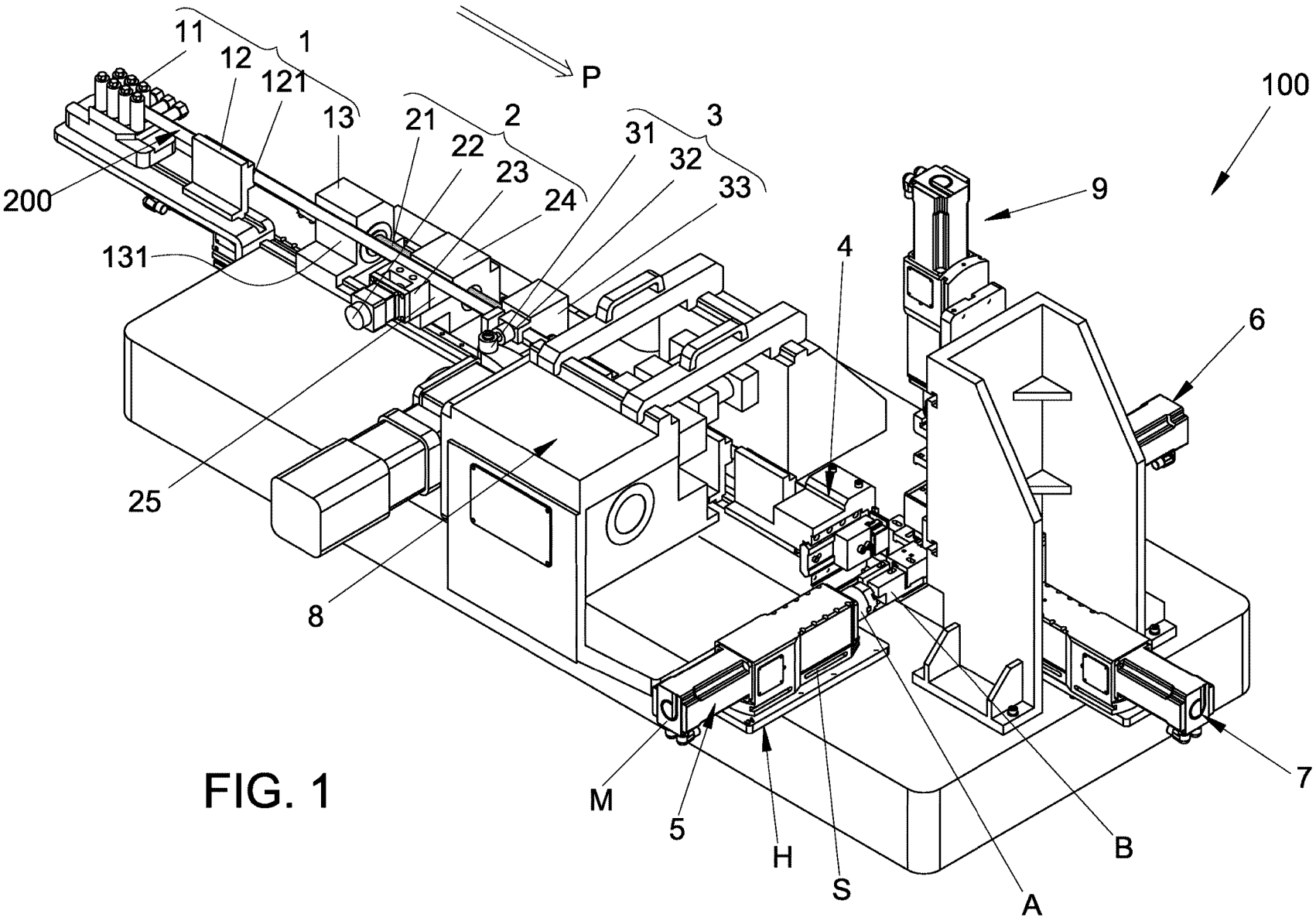
FIG. 1 is a perspective view of a metal material processing machine of a first preferred embodiment of the invention.
Figure 2:
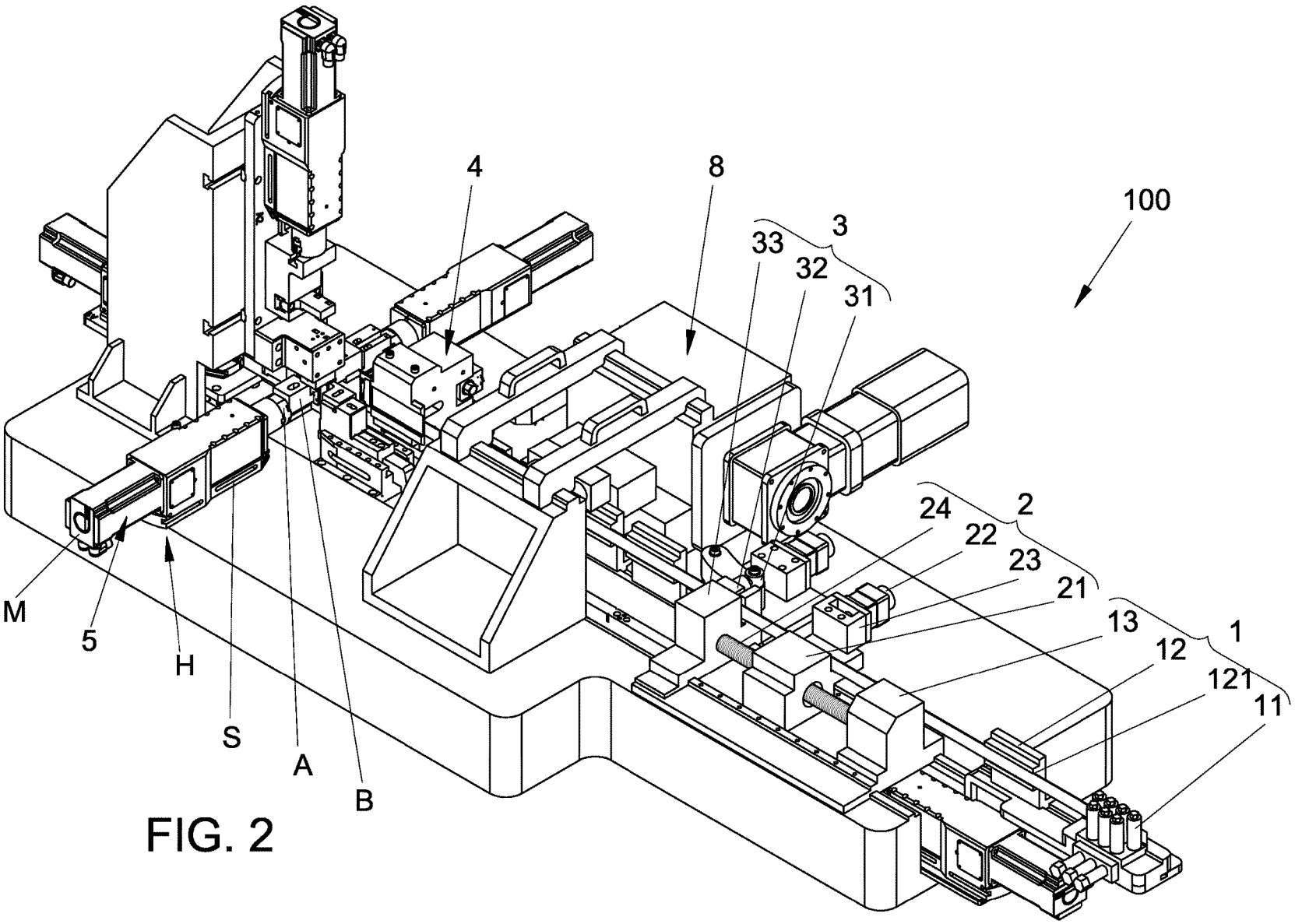
FIG. 2 is another perspective view of the metal material processing machine.
Figure 3:
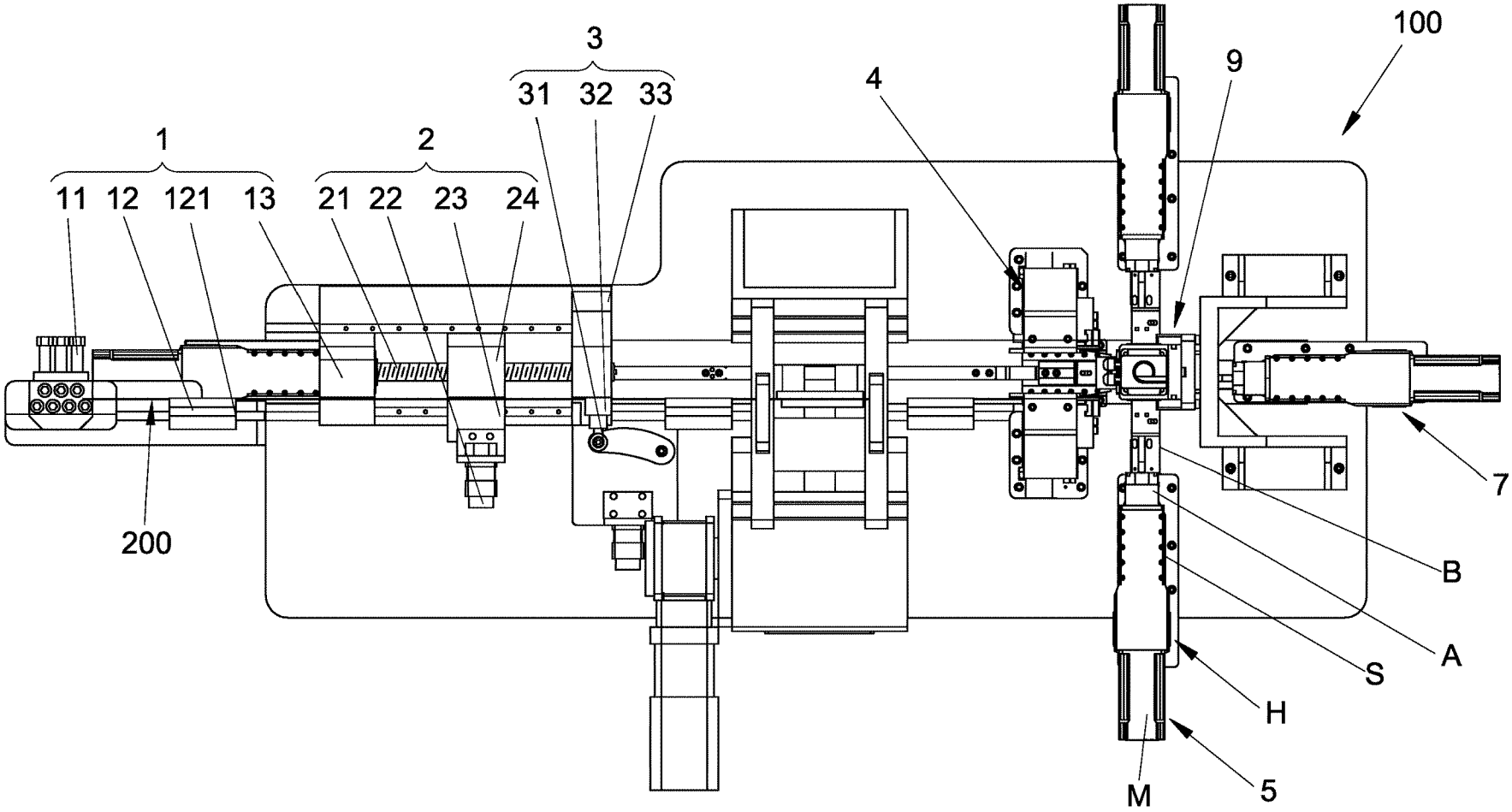
FIG. 3 is a top view of the metal material processing machine.
Figure 4:
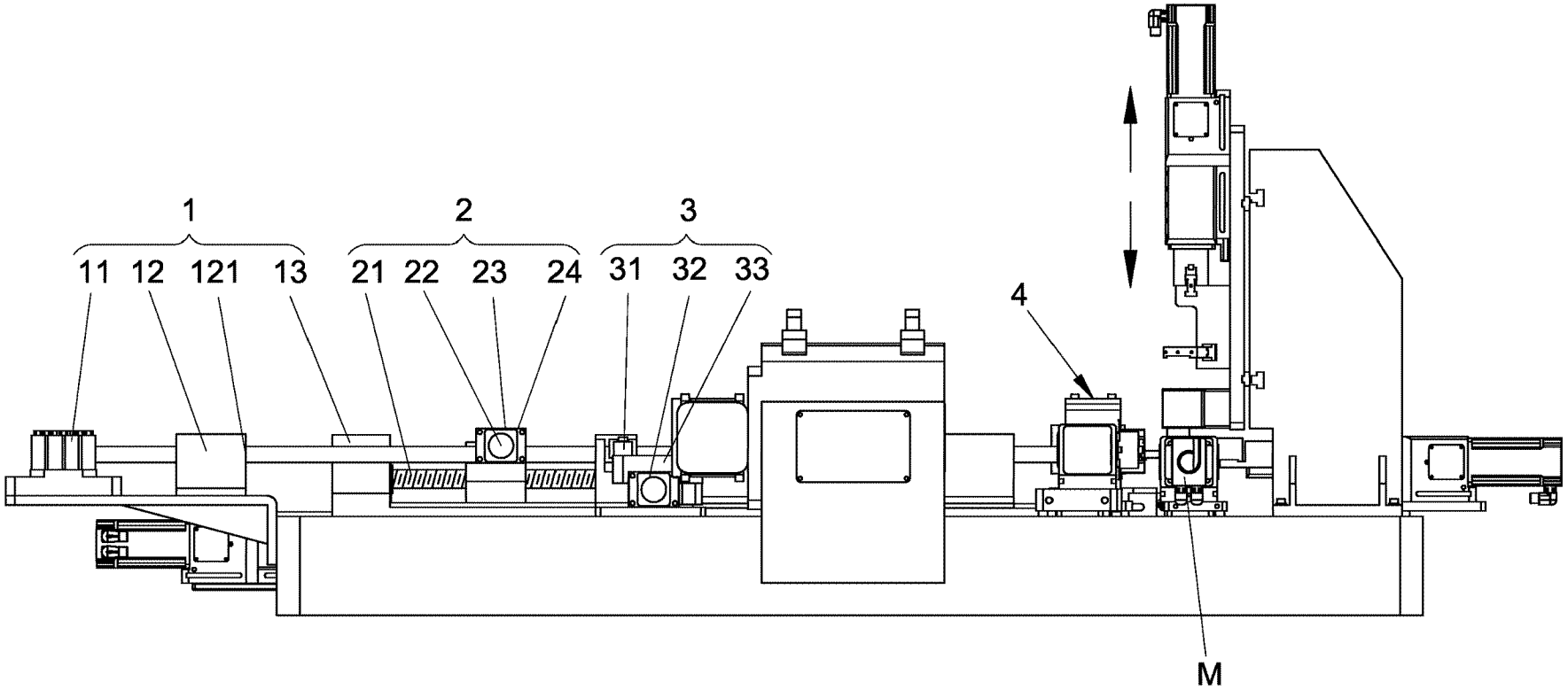
FIG. 4 is a side elevation of the metal material processing machine.
Figure 5:
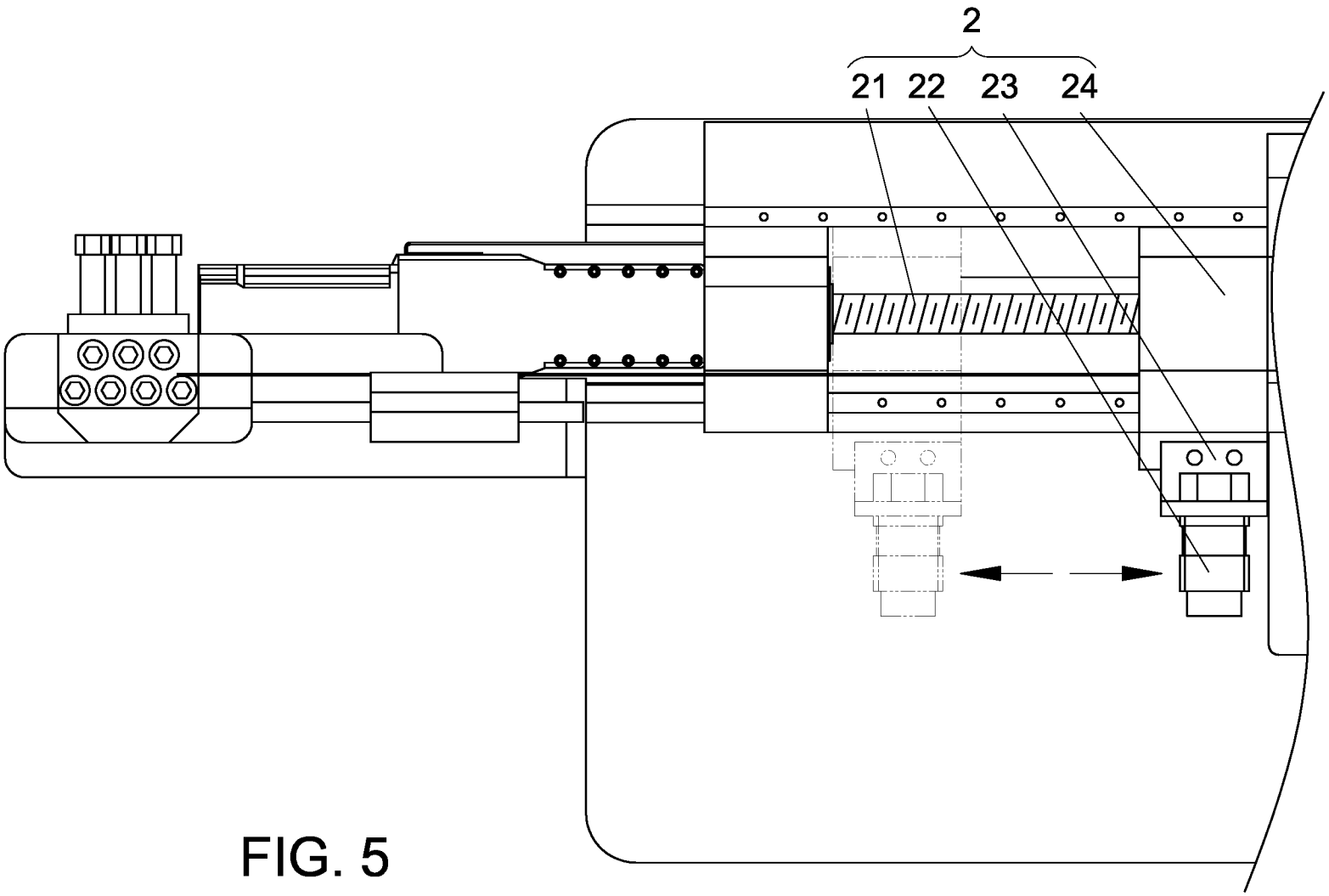
FIG. 5 schematically depicts operations of the moving device.
Figure 6B:
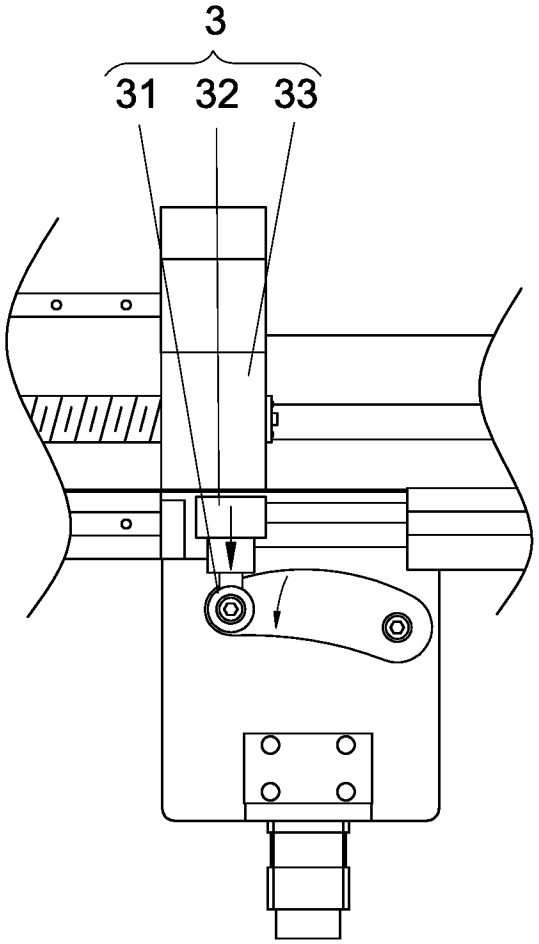
FIGS. 6A and 6B schematically depict operations of the guiding device respectively.
Figure 6A:
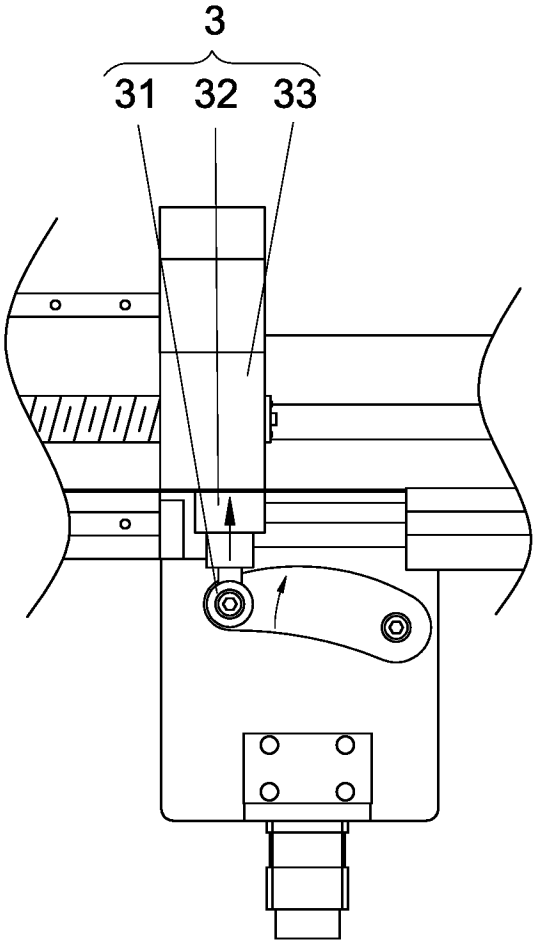
Figure 7B:
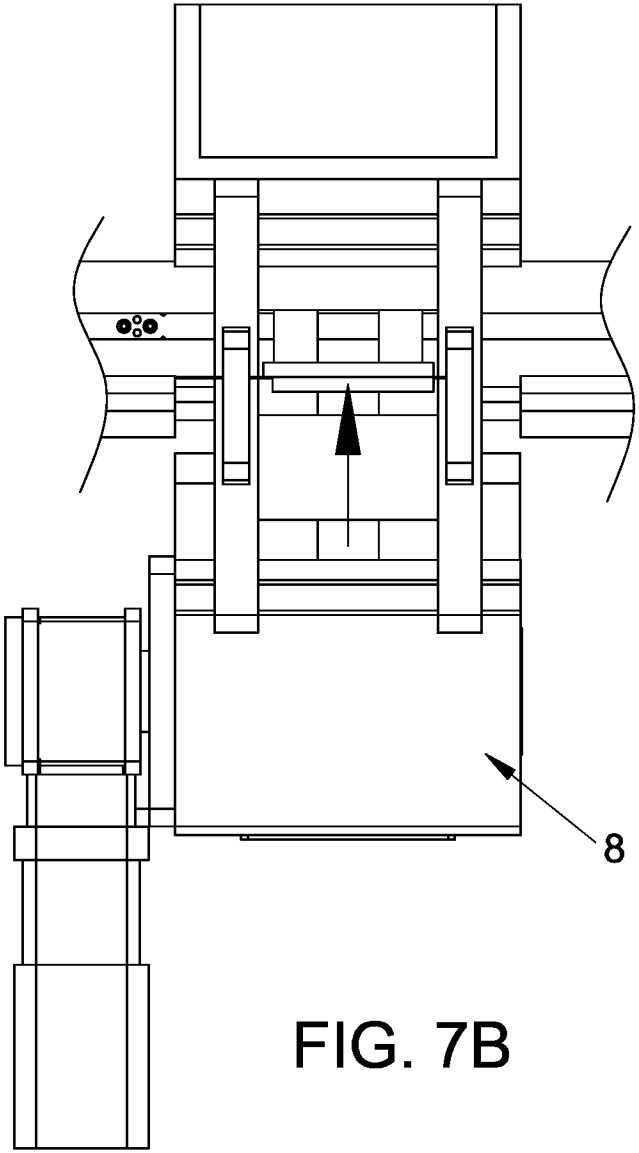
FIGS. 7A and 7B schematically depict operations of the pressing device respectively.
Figure 7A:
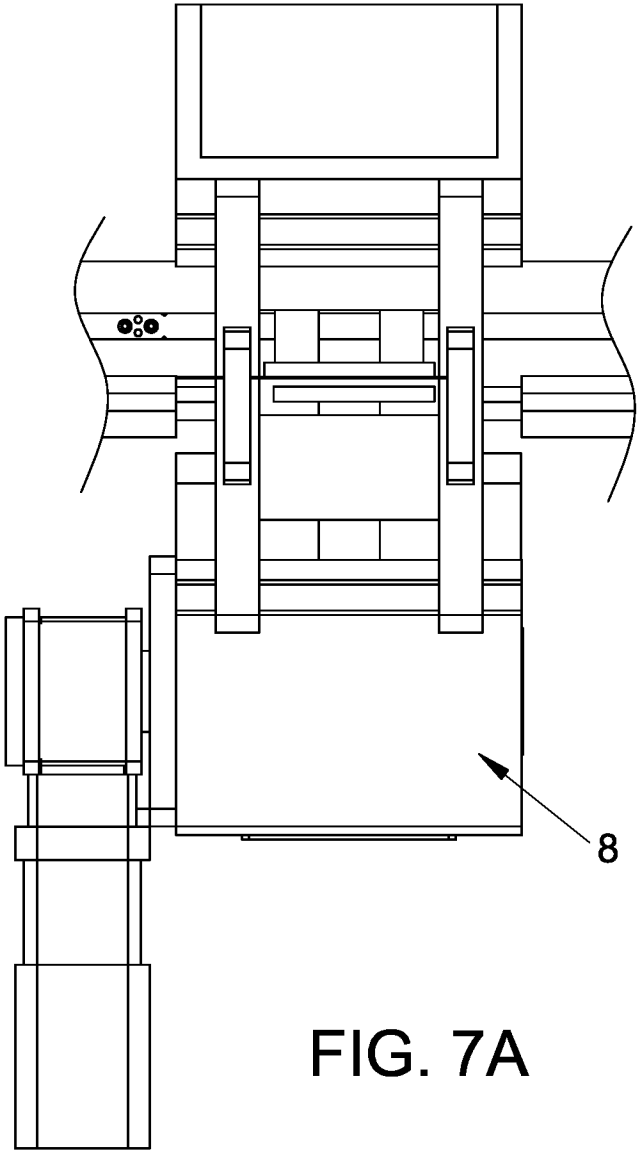

Referring to FIGS. 1 to 7B, a metal material processing machine 100 in accordance with a first preferred embodiment of the invention spreads along a feeding direction P and comprises a feeding device 1, a moving device 2, a guiding device 3, a first rail driven device 4, a second rail driven device 5, a third rail driven device 6, and a fourth device 7 as discussed in detail below.

The feeding device 1 may feed a metal material 200 along the feeding direction P. In the embodiment, the metal material 200 is either a metal wire having a disc-shaped cross-section or a polygonal cross-section or a metal bar. But it is not limited in other embodiments.

The feeding device 1 includes along the feeding direction P a plurality of upright rollers 11, a first support 12 having a first shoulder 121, and a second support 13 having a second shoulder 131. The metal material 200 passes the upright rollers 11, the first shoulder 121, and the second support 131. The first support 12 and the second support 13 are located at two opposite sides of the passing metal material 200. The first shoulder 121 is aligned with the second shoulder 131. The metal material 200 is moveably supported by both the first shoulder 121 and the second shoulder 131.

The moving device 2 includes a threaded shaft 21, a motor 22, a moveable member 23, and a main member 24. The threaded shaft 21 rotatably passes through the main member 24 so that the main member 24 may move forward and backward alternately along the feeding direction P. The moveable member 23 is disposed on the main member 24 and the motor 22 is operatively connected to the moveable member 23. The main member 24 and the moveable member 23 may move forward and backward alternately along the feeding direction P. Further, the moveable member 23 driven by the motor 22 may move relative to the main member 24 along a direction perpendicular to the feeding direction P. As a result, the metal material 200 passes a channel 25 between the moveable member 23 and the main member 24.

The guiding device 3 includes a motor 31, a guiding member 32, and a main member 33. The motor 31 is operatively connected to the guiding member 32 which is in turn disposed on the main member 33 so that the guiding member 32 driven by the motor 31 may move relative to the main member 33 along a direction perpendicular to the feeding direction P. As a result, the metal material 200 passes through the guiding member 32.

In operation, the moving device 2 moves the metal material 200 forward from a starting point along the feeding direction P. Further, the metal material 200 is guided by the guiding device 3. Next, the metal material 200 disengages from the moving device 2 and moves along a direction opposite to the feeding direction P until backs the starting point. Above operations are repeated to move the metal material 200 along the feeding direction P. In other words, the moving device 2 moves the metal material 200 forward along the feeding direction P and then the guiding device 3 guides the metal material 200.

The first rail driven device 4 is aligned with the feeding direction P. The second rail driven device 5 is aligned with the third rail driven device 6 and both the second rail driven device 5 and the third rail driven device 6 are perpendicular to the feeding direction P. The second rail driven device 5 and the third rail driven device 6 are disposed at two sides of the feeding direction P respectively. Also, the second rail driven device 5 is aligned with the third rail driven device 6. The fourth rail driven device 7 is aligned with the feeding direction P. The fourth rail driven device 7 is opposite to the first rail driven device 4.

The first rail driven device 4, the second rail driven device 5, the third rail driven device 6, and the fourth rail driven device 7 each include a motor M, a rail S, a driving shaft A, and a knife B. The motor M is disposed in the rail S. One end of the driving shaft A is operatively connected to the motor M and the other end thereof is connected to the knife B.

The first rail driven device 4, the second rail driven device 5, the third rail driven device 6, and the fourth rail driven device 7 each are releasably disposed on a board H.

For the metal material 200 being a metal wire, the metal material processing machine 100 further comprises pressing device 8 disposed between the guiding device 3 and the first rail driven device 4 for pressing the metal wire into a metal bar.

The metal material processing machine 100 further comprises a pushing device 9 uprightly disposed above a joining point of the first rail driven device 4, the second rail driven device 5, the third rail driven device 6, and the fourth rail driven device 7 for pushing the finished metal material 200 down into a collection box (not shown).

Figure 8:
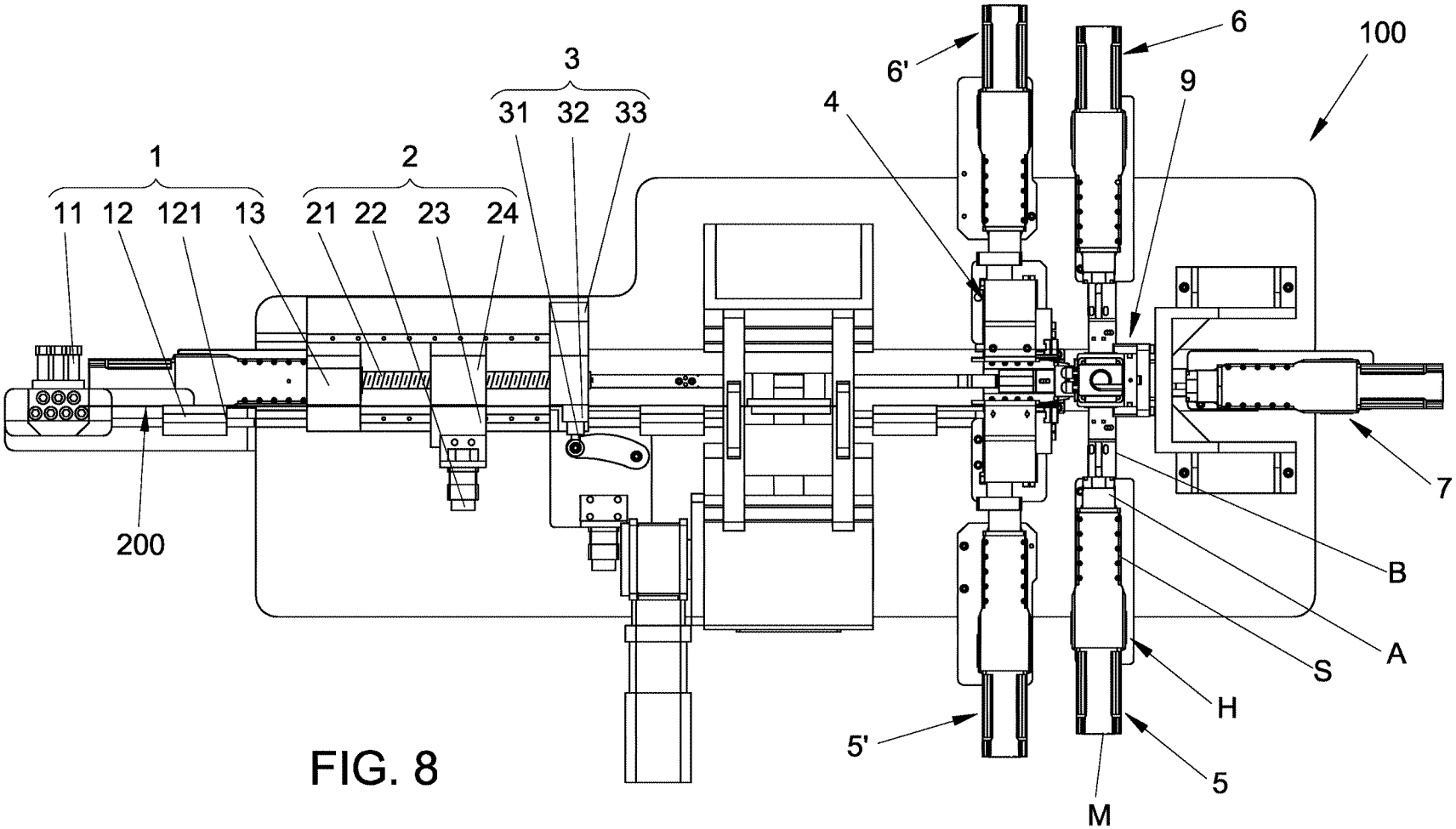
FIG. 8 is a top view of a metal material processing machine of a second preferred embodiment of the invention.

Referring to FIG. 8, a metal material processing machine 100 in accordance with a second preferred embodiment of the invention is shown. The characteristics of the second preferred embodiment are substantially the same as that of the first preferred embodiment except the following: there are further provided a fifth rail driven device 5' and a sixth rail driven device 6'. The fifth rail driven device 5' is spaced from and parallel to the second rail driven device 5. The sixth rail driven device 6' is spaced from and parallel to the third rail driven device 6. Each of the fifth rail driven device 5' and the sixth rail driven device 6' are structurally the same as that of the first rail driven device 4, the second rail driven device 5, the third rail driven device 6, or the fourth rail driven device 7. But it is not limited in other embodiments.

In short, the metal material processing machine 100 has four rail driven devices including the first rail driven device 4, the second rail driven device 5, the third rail driven device 6, and the fourth rail driven device 7. The rail driven devices 4, 5, 6 and 7 may process the metal material 200 with no other processing machines involved. Thus, it saves time. Further, the processing machine spreads out so that it is easy to detach and assemble. Additional rail driven devices such as the fifth rail driven device 5' and the sixth rail driven device 6' can be added depending on applications.

Further, the metal material processing machine 100 uses the threaded shaft 21 to move the main member 24 forward and backward alternately along the feeding direction P. The moveable member 23 driven by the motor 22 may move relative to the main member 24 along a direction perpendicular to the feeding direction P. Thus, the metal material 200 is moved forward. The main member 24 moves forward and backward alternately to move the metal material 200 along the feeding direction P.

While the invention has been described in terms of preferred embodiments, those skilled in the art will recognize that the invention can be practiced with modifications within the spirit and scope of the appended claims.

What is claimed is:

1. A metal material processing machine along a feeding direction comprising a feeding device, a moving device, a guiding device, a first rail driven device, a second rail driven device, a third rail driven device, and a fourth rail driven device, wherein:

the feeding device is configured to feed a metal material along the feeding direction;

the moving device is configured to move the metal material forward from a starting point along the feeding direction, the metal material is guided by the guiding device, the metal material is disengaged from the moving device, and the metal material is configured to move along a direction opposite to the feeding direction until backs the starting point;

the first rail driven device is aligned with the feeding direction;

the second rail driven device is aligned with the third rail driven device, the second rail driven device and the third rail driven device are perpendicular to the feeding direction respectively, and the second rail driven device and the third rail driven device are disposed at two sides of the feeding direction respectively; and the fourth rail driven device is aligned with the feeding direction, and the fourth rail driven device is opposite to the first rail driven device.

2. The metal material processing machine of claim 1, wherein the first rail driven device, the second rail driven device, the third rail driven device, and the fourth rail driven device each include a motor, a rail, a driving shaft, and a knife; the motor is disposed in the rail; and a first end of the driving shaft is operatively connected to the motor and a second end thereof is connected to the knife.

3. The metal material processing machine of claim 2, wherein the guiding device includes a first motor, a guiding member, and a first main member; the first motor is operatively connected to the guiding member which is in turn disposed on the first main member so that the guiding member driven by the first motor is configured to move relative to the first main member along a direction perpendicular to the feeding direction; and the metal material is configured to pass through the guiding member.

4. The metal material processing machine of claim 3, wherein the moving device includes a threaded shaft, a second motor, a moveable member, and a second main member; the threaded shaft rotatably passes through the second main member so that the second main member is configured to move forward and backward alternately along the feeding direction; the moveable member is disposed on the second main member and the second motor is operatively connected to the moveable member; the second main member and the moveable member are configured to move forward and backward alternately along the feeding direction; the moveable member driven by the second motor is configured to move relative to the second main member along a direction perpendicular to the feeding direction; and the metal material is configured to pass a channel between the moveable member and the main member.

5. The metal material processing machine of claim 4, wherein the feeding device includes along the feeding direction a plurality of upright rollers, a first support having a first shoulder, and a second support having a second shoulder; the metal material is configured to pass the upright rollers, the first shoulder, and the second support; the first support and the second support are located at two opposite sides of the passing metal material respectively; the first shoulder is aligned with the second shoulder; and the metal material is moveably supported by the first shoulder and the second shoulder.

6. The metal material processing machine of claim 1, wherein the metal material is a metal wire.

7. The metal material processing machine of claim 6, further comprising a pressing device disposed between the guiding device and the first rail driven device, the pressing device being configured to press the metal wire into a metal bar.

8. The metal material processing machine of claim 1, further comprising a pushing device uprightly disposed above a joining point of the first rail driven device, the second rail driven device, the third rail driven device, and the fourth rail driven device.

9. The metal material processing machine of claim 1, further comprising a fifth rail driven device, the fifth rail driven device being spaced from and parallel to the second rail driven device.

10. The metal material processing machine of claim 9, further comprising a sixth rail driven device, the sixth rail driven device being spaced from and parallel to the third rail driven device.

* * * * *